United States Patent [19]

Gilbert

[11] Patent Number: 4,841,203

[45] Date of Patent: Jun. 20, 1989

[54] ELECTRIC TROLLING MOTOR STEERING SYSTEM

[76] Inventor: David A. Gilbert, 76542 Meadow Way, Oak Ridge, Oreg. 97463

[21] Appl. No.: 200,728

[22] Filed: May 31, 1988

[51] Int. Cl.[4] ..... B63H 21/26

[52] U.S. Cl. ..... 318/53; 318/10; 114/144 R; 114/144 RE; 114/153; 440/7

[58] Field of Search ..... 318/9, 10, 11, 12, 15, 318/51, 53, 54, 55, 59, 65, 588; 114/255, 144 R, 144 RE, 144 A, 154, 155, 156, 157, 158, 153; 440/6, 7

[56] References Cited

U.S. PATENT DOCUMENTS

| | | | |
|---|---|---|---|
| 3,598,947 | 8/1971 | Osborn | 440/7 X |
| 3,980,039 | 9/1976 | Henning | 440/6 |
| 4,066,032 | 1/1978 | Travis | 440/6 |
| 4,151,807 | 5/1979 | Black, Jr. | 440/6 X |
| 4,527,983 | 7/1985 | Booth | 440/7 |
| 4,587,388 | 5/1986 | Cavin | 440/7 X |
| 4,614,900 | 9/1986 | Young | 114/144 RE X |
| 4,723,500 | 2/1988 | Havins, Sr. | 440/7 X |

*Primary Examiner*—Bentsu Ro
*Attorney, Agent, or Firm*—John F. Ingman

[57] ABSTRACT

A permanent magnet direct-current gearhead motor is supported by a base member so that its output gear motion is transmitted to a splined steering shaft which descends and is attached to the electric trolling motor itself. The transmission of motion between the gearhead motor and the spline gear on the upper end of the steering shaft may utilize a larger intermediate gear so that limit switches can be installed thereon to limit the range of rotation of the gears, and thus of the trolling motor itself. The direction of the gearhead motor rotation is dependent on the polarity of the direct current applied; the desired polarity being established through by button-type switches connected through a double throw, double pole direct current relay which is housed on the base member, adjacent to the gearhead motor. The button switches may be positioned at a multiple number of different locations within the boat, wherever desired. A preferred triangular three button switch arrangement is utilized wherein two buttons are used to change the direction of the motor and the third button used as an on-off switch for the operation of the trolling motor itself. A pointer, which indicates the direction in which the trolling motor is pointing, may extend above the cover which encloses the gearhead motor and relay, the pointer being geared from the gearhead motor the same as the splined shaft for movement of the trolling motor.

6 Claims, 3 Drawing Sheets

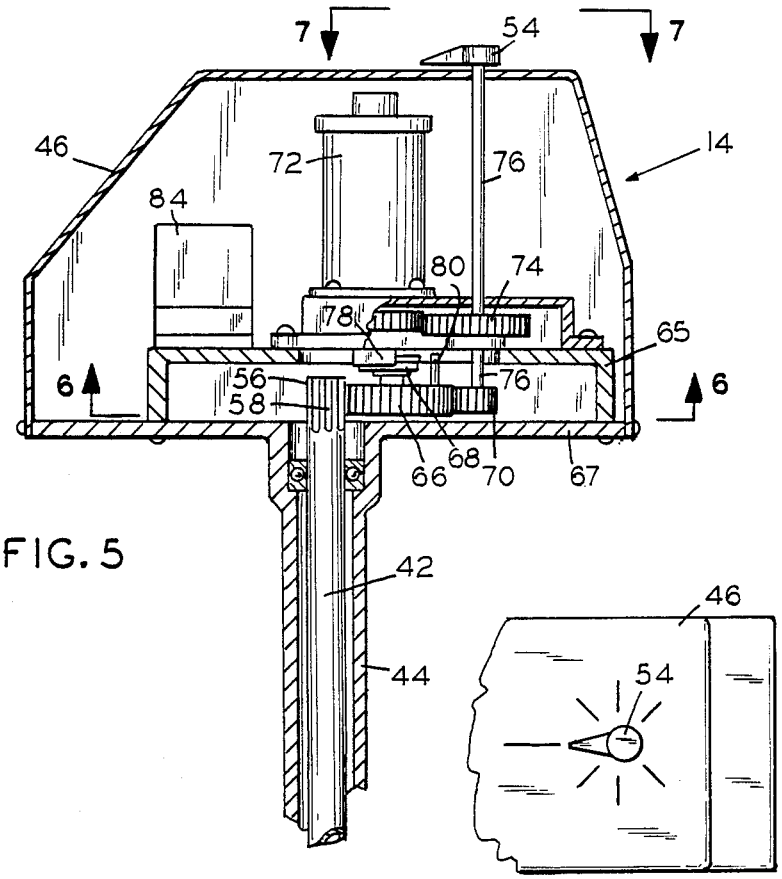
FIG. 5
FIG. 7
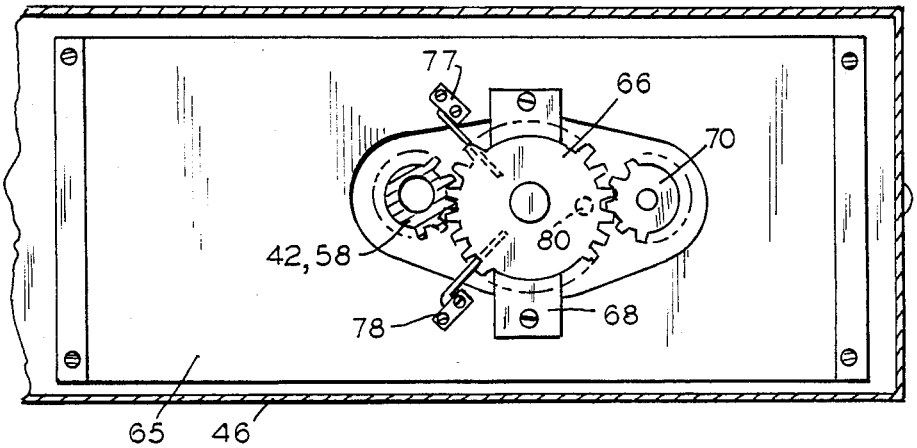
FIG. 6

FIG. 8
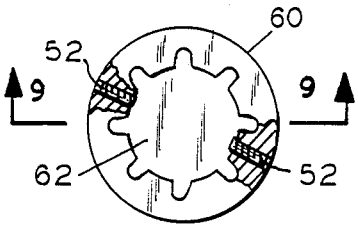
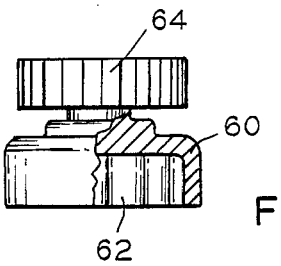
FIG. 9
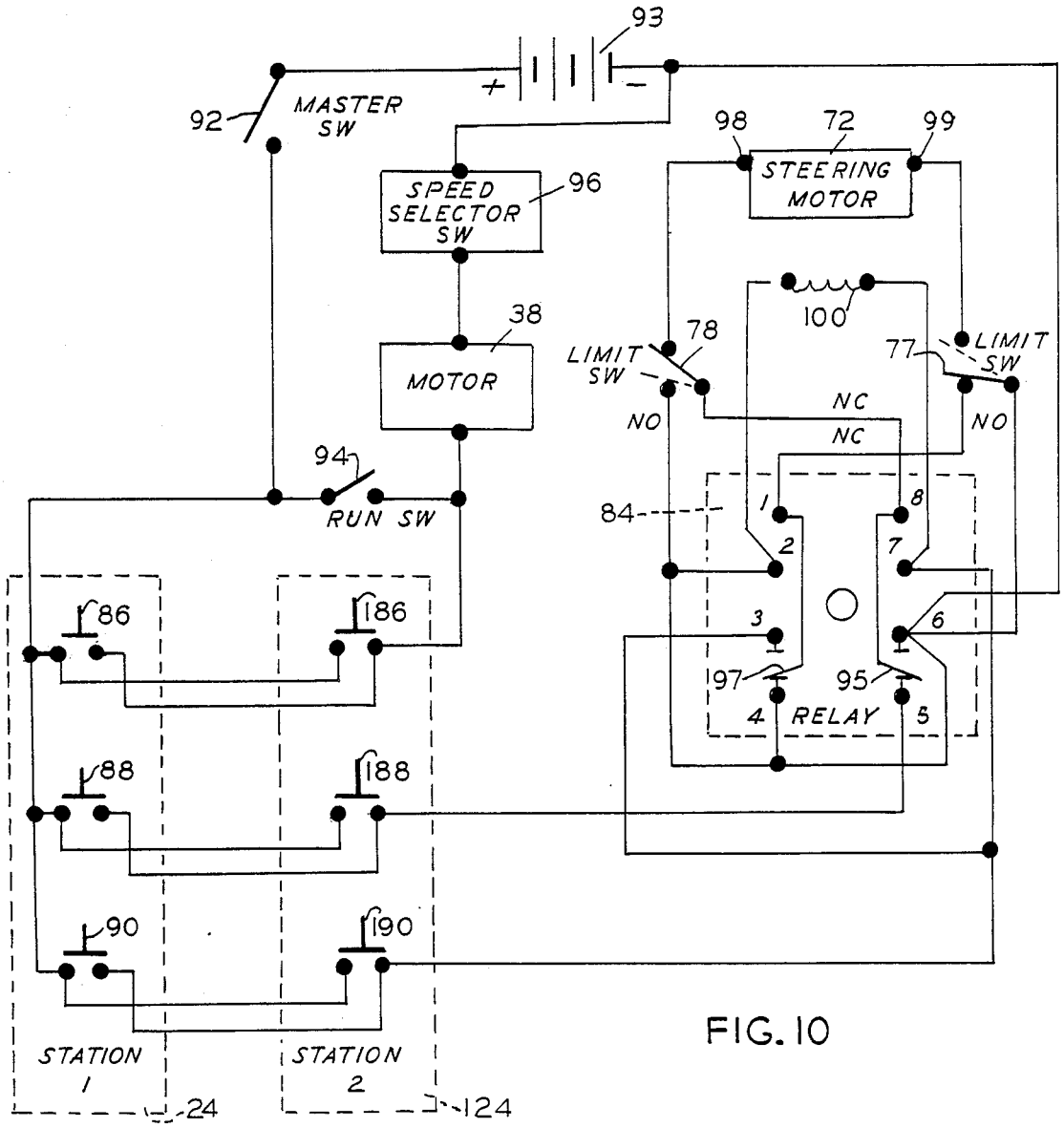
FIG. 10

ELECTRIC TROLLING MOTOR STEERING SYSTEM

BACKGROUND OF THE INVENTION

1. Field of the Invention

This invention involves an electric trolling motor steering system for boats, and, more particularly, an electric trolling motor steering system having multiple steering stations.

2. Description of the Prior Art

Smaller electric motors for trolling, as produced by the major manufacturers thereof, generally utilize a mechanical system for steering which involves a pedal arrangement incorporating wire cables from the pedal to physically turn the motor to steer the boat. Such pedal-cable apparatus has proved to be awkward to operate and is limited to a single steering station.

What is needed is an improved system for the steering of boats using electric trolling motors which eliminates the mechanical wire cable steering means and which allows a number of steering station locations to be utilized.

SUMMARY OF THE INVENTION

The present invention provides an electric trolling motor steering system designed to satisfy the aforementioned need. The invention involves the use of an electric gearhead motor, which is electrically controlled from any of a plurality of stations located within the boat, to steer the boat by rotation of the trolling motor.

Accordingly, in the preferred embodiment, a permanent magnet direct current gearhead motor is supported by a base member so that its output gear motion is transmitted to a splined steering shaft which descends and is attached to the electric trolling motor itself. The transmission of motion between the gearhead motor with an associated output gear, and the spline gear on the upper end of the steering shaft may be accomplished by means of a larger intermediate gear so that limit switches may be installed on the intermediate gear to limit the range of rotation of the gears, and thus of rotation of the trolling motor itself. The gearhead motor may be powered by the same battery that provides electricity for the trolling motor, the direction of the gearhead motor rotation, and thus the rotation of the steering shaft and the trolling motor, being dependent on the polarity of the direct current applied to the gearhead motor, i.e., the direction in which the trolling motor is rotated is changed by reversing the polarity of the direct current applied to the gearhead motor. The polarity is established through the use of two button-type switches connected through a double throw, double pole direct current relay. The relay may be housed on the base member, adjacent to the gearhead motor. The button switches themselves may be positioned at a multiple number of different locations within the boat, wherever desired. A three button switch arrangement may be utilized wherein two buttons are used to change the direction of the trolling motor and the third button used as an on-off switch for the operation of the trolling motor itself, so that ball-of-foot pressure will energize the trolling motor while rocking the foot to one side or the other will steer the boat by rotation of the trolling motor.

A pointer, which indicates to the operator the direction in which the trolling motor is pointing, may upwardly extend out of a cover which encloses the gearhead motor and related components, a vertical shaft holding the pointer being geared from the gearhead motor as is the spline-geared shaft for movement of the trolling motor.

BRIEF DESCRIPTION OF THE DRAWINGS

FIG. 5 illustrates a sectional side view of the upper portion of the the electric trolling motor of FIG. 2.

FIG. 6 illustrates a sectional view of the electric trolling motor as seen at 6—6 of FIG. 5.

FIG. 7 illustrates a partial top view of the electric trolling motor as seen at 7—7 of FIG. 5.

FIG. 8 illustrates a bottom view of a gear adaptor, as may be utilized with some steering shaft configurations.

FIG. 9 illustrates a partial section of the gear adaptor, as seen at 9—9 of FIG. 8.

FIG. 10 illustrates a schematic wiring diagram of the electric trolling motor steering system.

DESCRIPTION OF THE PREFERRED EMBODIMENT

Figure 1:
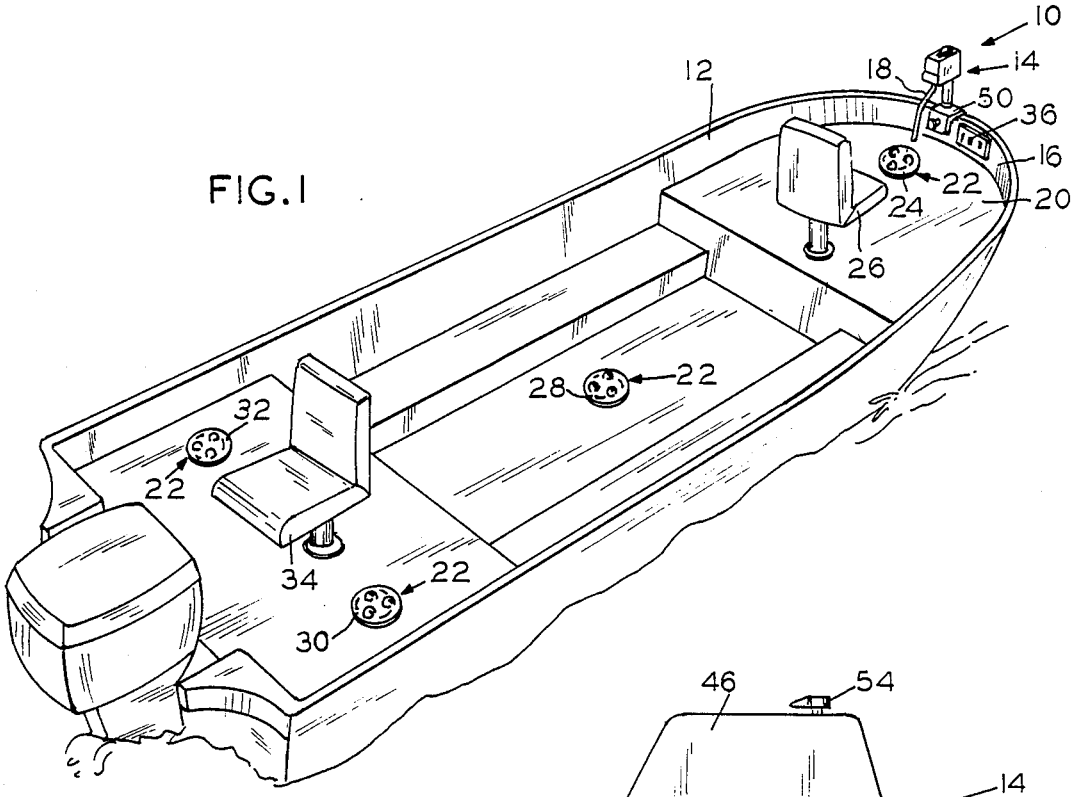
FIG. 1 illustrates the electric trolling motor steering system as installed on a bass boat.

Referring now to the drawings, the preferred embodiment of the electric trolling motor steering system 10 is shown as mounted on a bass boat 12. As illustrated, an electric trolling motor 14 is mounted at the bow 16 of the boat 12, as by a a motor clamp 50 or other conventional means. A wiring cable 18 extends from the electric trolling motor 14 to within the decking 20. Multiple steering stations 22 are illustrated; one steering station 24 being located proximate to the front seat 26 at the bow 16. A second steering station 28 is located amidships, while two additional steering stations 30 and 32 are aft, permitting operation by someone in the aft chair 34, allowing control while fishing over either side of the boat 12. Clearly, the placing of the multiple steering stations 22 within the boat 12 is a matter of individual choice. A switch panel 36 may be located near the bow 16 to provide a master switch 92, a switch 94 to provide continuous power to the electric trolling motor 14 and a switch 96 to select the trolling speed thereof, as will be discussed subsequently.

Figure 2:
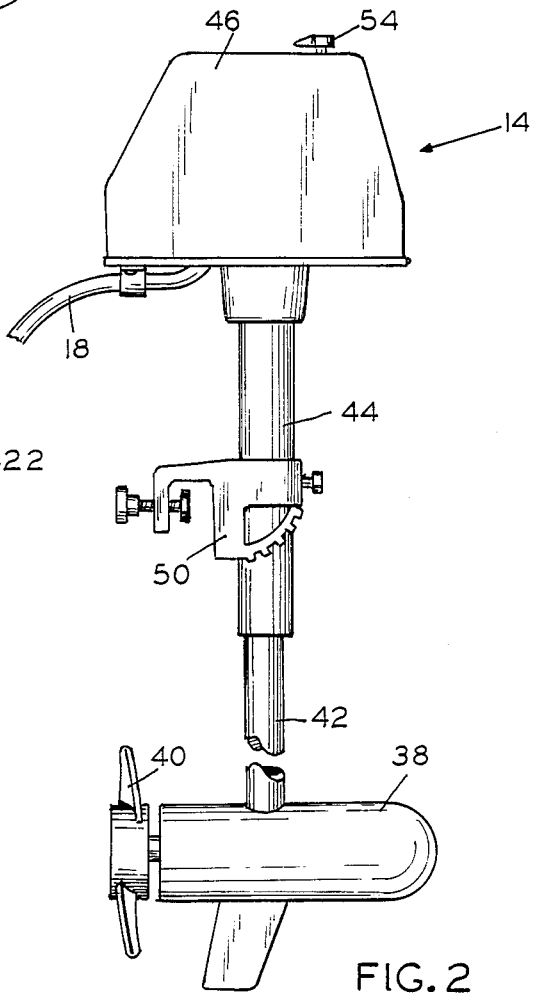
FIG. 2 illustrates an electric trolling motor as utilized with the instant electric trolling motor steering system.

FIG. 2 shows a side view of the electric trolling motor 14. As common with electric trolling motors, an encased electric motor 38, which drives propeller 40, is mounted on a rotating steering shaft 42 extending upwards through a fixed steering shaft housing 44 which is attached to the boat 14, here by a motor clamp 50. Attached to the steering shaft housing 44 is upper cover 46 from which emanates electric cable 18 and a directional pointer 54.

FIG. 5 provides a cross section of the upper portion of the electric trolling motor 14 and associated mechanical details. Electrical wiring has been omitted from the view for clarity, a wiring diagram being found at FIG. 10; it should be noted that the steering shaft 42 is of hollow tubular form and that the wiring supplying power to the encased motor 38 at the lower end of the steering shaft 42 proceeds through the steering shaft 42. Steering shaft 42 extends upward through steering shaft housing 44, the upper end 56 of the steering shaft 42 being formed as a spline gear 58.

In some trolling motors, however, the upper end 56 is formed as a chain sprocket, so that a gear adaptor 60, as shown in FIG. 8 and FIG. 9, is necessary. The gear adaptor 60 has a lower depression 62 in the form of a chain sprocket and an upper end 64 which is in the form of a gear, so that the placement of the gear adaptor 60 on top of a sprocket formed upper end 56 and secured by set screws 52 or the like, transforms the upper end 56 to the gear form compatable with other gearing of the present electric trolling motor steering system 10.

A base member 65 is attached to an outwardly extending flange 67 which is formed at the upper end of the steering shaft housing 44.

Engaged with the spline gear 58 is an intermediate gear 66 which is conventionally supported by the base member 65 at 68. A preferred intermediate gear 66 will have twice the number of teeth as the spline gear 58, e.g., for a spline gear with 16 teeth, the larger intermediate gear 66 will have 32 teeth, with a resulting rotational movement of 50% of the movement of the spline gear 58. Engaging the intermediate gear 66 is output gear 70 which is powered by a gearhead motor 72 with its internal gearing 74 as applied to output shaft 76 which extends therefrom. A permanent magnet, direct current gearhead motor 72 of 1/90 horsepower, whose output is designed, through the its internal gearing 74, to be twelve revolutions per minute. The output gear 70 has the same number of teeth, e.g., 16, as the spline gear 58, and thus one-half the number of teeth of the intermediate gear 66, so that rotation of the drive gear 70 will create identical rotation of the steering shaft 42 and the encased electric motor 38, and thus direction of propulsion by the propeller 40. However the larger intermediate gear 66 will rotate only half as far, thereby permitting the installation of limit switches 77 and 78 to interact with switch triggering means, such as a protrusion 80 formed with the intermediate gear 66, to limit the range of rotation of the gears 58, 66, and 70, and thus the motor 38 itself. Through placement of the limit switches 77 and 78 and their triggering means 80 at, for example, as illustrated, a separation of approximately 270 degrees or $\frac{3}{4}$ of a complete revolution of the intermediate gear 66, the maximum allowable rotation of the motor 38 and propeller 40 would be approximately $1\frac{1}{2}$ revolutions. This provides adequate direction changing maneuverability for the motor 38 and propeller 40 without endangering the electrical power cables which proceed to the motor 38 through the hollow steering shaft 42, due to excessive twisting. It is preferred, however, to limit rotation of the motor 38 and propeller 40 to a single revolution, so that limit switch 77, 78 placement is separated by 180 degrees relative to the intermediate gear 66. This limits rotation of the motor 38 and propeller 40 to a reverse direction, whereat the limit switch 77 or 78 conveniently terminates further rotation.

The vertical output shaft 76 extending out of the gearhead motor 72, as indicated in the illustrations, is topped by a pointer 54 which indicates to the operator the direction in which the motor 38 and propeller 40 unit is pointing. This is possible because the output gear 70 of the gearhead motor 72 and the spline gear 58 on the steering shaft 42 are the same, i.e., have the same number of teeth.

The gearhead motor 72 is powered by the same direct current power source (at 93 in FIG. 10), e.g., battery or batteries, that provide electricity for the motor 38; the charge used by the gearhead motor 72 is negligible due to its small size and intermittent use. The direction of gearhead motor rotation, and thus the rotation of the steering shaft 42 and the motor 38, is dependent on the polarity of the direct current applied to the gearhead motor 72. Thus the direction of the motor 38 is rotated in one direction or the other as desired by reversing the polarity of the voltage appled to the gearhead motor 72. This is accomplished by the application of two button switches 82 connected through a double-throw double-pole direct current relay 84. The relay 84 is physically housed on the base member 65 adjacent to the gearhead motor 72.

A steering station 22 has been designed to house the two button switches 82 which may be used to change the direction of propulsion by the electric trolling motor 14. In addition, the preferred steering station provides a third button switch 82 whose function is to energize the motor 38 itself. Thus a three button switch steering station 22 has been configured to allow the operator, by placing a foot on the steering station 22, to energize the motor 38, while rocking the foot to one side or the other will steer the boat by rotation of the motor 38 on the steering shaft 42.

Figure 3:
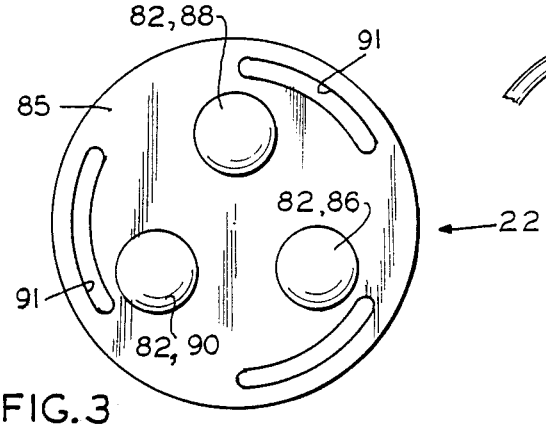
FIG. 3 illustrates a plan view of a steering station member of the electric trolling motor steering system.
Figure 4:
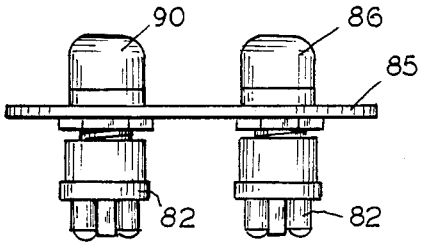
FIG. 4 illustrates a side view of the steering station member of FIG. 3.

FIG. 3 and FIG. 4 better illustrate the preferred three button steering station 22. With button 86 as the on-off switch for the motor 38, button 88 as a right turn switch and button 90 as a left turn switch, the steering station 22 is placed with button 86 towards or closer to the user. The steering stations 22 are preferably mounted flush with the decking 20 of the boat, so that the wiring between steering stations 22, power sources and other switches, and the trolling motor 14 are out of sight beneath the decking 20 and not under foot. A preferred steering station 22 configuration includes a base plate 85 of $5\frac{1}{4}$-inches in diameter with the one-inch diameter button switches 86, 88 and 90 forming a triangular arrangement, as illustrated. The right turn button 88 and the left turn button 90 both are separated by $2\frac{1}{8}$-inches, center-to-center, from the off-on button 86, and by $2\frac{3}{4}$-inches, center-to-center, from each other. Arcuate $\frac{1}{4}$-inch wide slots 91, each spanning approximately sixty degrees of the circumference, are provided for adjustable attachment of the steering station 22 to the decking 20 or other installation location by screws or other means.

A multiple number of steering stations 22 may be installed in a boat, as is illustrated in FIG. 1. FIG. 10 provides a schematic wiring diagram of the electric motor steering system 10 wherein two steering stations 22, here identified as 24 and 124 are utilized. However, any number of steering stations 22 may be parallel connected within the electric trolling motor steering system 10 as will be appreciated by those skilled in the electrical arts.

Located on steering stations 24 and 124 are the on-off switches 86 and 186, the right turn switches 88 and 188, and the left turn switches 90 and 190 respectively.

A master switch 92 provides power from direct current power source 93 to the circuit, while a continutous run switch 94 provides constant power to the motor 38 for continuous trolling movement. A speed selector switch 96 provides means of selection, either discreetly or by reostat, of the amount of voltage available to the motor 38 and thus determines its speed. Switches 92, 94, and 96 may be positioned at a common location, it having been found preferable with the present system to locate them at switch panel 36 conveniently placed near the bow 16 of the boat 12.

With the continuous run switch 94 open, power can be provided to the motor 38 by pressing either switch 86 at steering station 24 or switch 186 at steering station 124. Releasing of the pressed switch 86 or 186 breaks the power circuit to the motor 38.

Steering by means of the orientation of the motor 38 and propeller 40 is accomplished by pressing either switch 88 or 188 to turn the motor 38 and propeller 40 to the right, or by pressing switch 90 or 190 to turn the motor 38 and propeller 40 to the left. As can be seen in FIG. 10, pressing switch 88 or 188 will establish a positive voltage at relay position 5, hence through the relay 84 to relay position 8, through limit switch 78 to a first electrical input 98 to the steering motor 72; the second electrical input 99 to the steering motor 72 is at ground or negative with respect to the positive voltage, such voltage being at the potential of relay terminal 1 and of relay terminals 4 and 6, the latter being connected directly to the negative terminal of the direct current power source 93.

For a left turn of the motor 38 and propeller 40, pressing of switch 90 or 190 will place the positive voltage at relay terminals 3 and 7. The positive voltage at relay terminal 7 is placed across the internal coil 100 of the relay 84 (between relay terminal 7 and relay terminal 2), thus magnetically attracting the internal relay contact 95 attached to relay terminal 8 away from relay terminal 5 and into contact with relay terminal 6, and the internal relay contact 97 attached to relay terminal 1 away from relay terminal 4 and into contact with relay terminal 3. Since the positive voltage also has been placed at relay terminal 3, that voltage then follows through relay terminal 1 and through limit switch 77 to the second electrical input 99 to the the steering motor 72. Correspondingly, the ground or negative voltage has progressed through relay terminal 6, through the internal relay contact 95 to relay terminal 8, through the limit switch 78 to the first electrical input 98. Thus the voltage across the steering motor 72 is now opposite in polarity when switch 90 or 190 is pressed as when switch 88 or 188 is pressed, and the permanenet magnet direct current steering motor 72 will turn in the opposite direction.

Should both the right turn switch 88 or 188 and the left turn switch 90 or 190 be pushed simultaneously, the pressing of the switch 90 or 190 will continue to energize the internal coil 100 and attract the contacts 95 and 97 to the left turn configuration. The steering motor 72 will turn to the left as if only the left turn switch 90 or 190 had been pressed.

Finally, when the limit switches 77 or 78 have been triggered by rotation of the intermediate gear 66, as described previously, the circuit carrying the positive voltage is interrupted and replaced with the ground or negative voltage. Limit switch 78 operates to limit the extent of a right turn while limit switch 77 limits the extent of the left turn. Such limit switch induced ground or negative voltage is the same as that applied as a result of engaging the opposite direction switch for a reversal in direction of movement, and thus the steering motor 72 can be reversed from either limit actuated position immediately.

It is thought that the electric trolling motor steering system of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A steering system for electric trolling motors, which comprises:

a steering shaft, axially rotating within a steering shaft housing having boat attachment means, the steering shaft having a first end extending above the steering shaft housing and a second end extending below the steering shaft housing and attached to an electric motor with propeller;

a base member mounted on top of the steering shaft housing;

a direct current electrical power source;

an electric gearhead motor mounted on the base member, and having an output shaft extending therefrom;

a spline gear formed on the first end of the steering shaft;

an output gear attached to said output shaft from the gearhead motor, and interconnected to said spline gear;

a plurality of remote steering station members, each steering station member comprising a base plate and three electric push switches installed thereon; wherein a first push switch is electrically connected to and energizes said electric motor with propeller; a second push switch is electrically connected to and energizes the gearhead motor thereby rotating, through said gearing, the steering shaft and thus the electric motor with propeller in a first direction; and a third push switch which energizes the gearhead motor similar to the second push switch but with polarity reversed, so as to rotate the steering shaft and the electric motor with propeller in a second and opposite direction;

said three switches being installed on said base plate in a spaced triangular relationship so that placement of a user's foot will energize said first push switch; and tilting of the foot to the right will also energize the second push switch, or tilting of the foot to the left will also energize said third push switch.

2. The steering system for electric trolling motors, as recited in claim 1 above, wherein additionally there is included:

an intermediate gear interconnecting said spline gear and said output gear, said intermediate gear having limit switch triggering means; and a plurality of limit switches installed with relation to the limit switch triggering means of the intermediate gear, so as to terminate movement of the gearhead motor to limit the extent of rotational movement of the spline gear of the steering shaft and its attached electric motor with propeller.

3. The steering system for electric trolling motors, as recited in claim 1 above, wherein the output gear and the spline gear are of the same diameter, having the same number of teeth, and additionaly there is included a directional pointer attached to an end of the output shaft from the gearhead motor.

4. The steering system for electric trolling motors, as recited in claim 2 above, wherein said intermediate gear is of twice the diameter and number of teeth as the spline gear, and two limit switches are installed at a separation of 270-degrees about the intermediate gear, so as to limit the movement of the spline gear and thus the electric motor with propeller to one and one-half revolutions.

5. The steering system for electric trolling motors, as recited in claim 2 above, wherein said intermediate gear is of twice the diameter and number of teeth as the spline gear, and two limit switches are installed at a separation of 180-degrees about the intermediate gear, so as to limit the movement of the spline gear and thus the electric motor with propeller to a single revolution.

6. A steering system for electric trolling motors, which comprises:

a steering shaft, axially rotating within a steering shaft housing having boat attachment means, the steering shaft having a first end extending above the steering shaft housing and a second end extending below the steering shaft housing and attached to an electric motor with propeller;

a base member mounted on top of the steering shaft housing;

a direct current electrical power source;

an electric gearhead motor mounted on the base member, and having an output shaft extending therefrom;

a spline gear formed on the first end of the steering shaft;

an output gear connected to said output shaft from the gearhead motor;

an intermediate gear interconnecting said spline gear and said output gear, said intermediate gear having limit switch triggering means;

a plurality of limit switches installed with relation to the limit switch triggering means of the intermediate gear, so as to terminate movement of the gearhead motor to limit the extent of rotational movement of the spline gear of the steering shaft and its attached electric motor with propeller;

a plurality of remote steering station members, each steering station member comprising a base plate and three electric push switches installed thereon; wherein a first push switch is electrically connected to and energizes said electric motor with propeller; a second push switch is electrically connected to and energizes the gearhead motor thereby rotating, through said gearing, the steering shaft and thus the electric motor with propeller in a first direction; and a third push switch which energizes the gearhead motor similar to the second push switch but with polarity reversed, so as to rotate the steering shaft and the electric motor with propeller in a second and opposite direction;

said three switches being installed on said base plate in a spaced triangular relationship so that placement of a user's foot will energize said first push switch; and tilting of the foot to the right will also energize the second push switch, or tilting of the foot to the left will also energize said third push switch.

* * * * *